US012030737B2

(12) United States Patent
Takahara

(10) Patent No.: US 12,030,737 B2
(45) Date of Patent: Jul. 9, 2024

(54) FEEDING DEVICE

(71) Applicant: CANON KABUSHIKI KAISHA, Tokyo (JP)

(72) Inventor: Hiroyuki Takahara, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 121 days.

(21) Appl. No.: 17/173,015

(22) Filed: Feb. 10, 2021

(65) Prior Publication Data

US 2021/0253384 A1 Aug. 19, 2021

(30) Foreign Application Priority Data

Feb. 17, 2020 (JP) ..... 2020-024188

(51) Int. Cl.
*B65H 3/06* (2006.01)

(52) U.S. Cl.
CPC ..... *B65H 3/0684* (2013.01); *B65H 3/0669* (2013.01); *B65H 2403/51* (2013.01)

(58) Field of Classification Search
CPC ..... B65H 3/0684; B65H 3/0669; B65H 2403/51; B65H 1/00; B65H 2405/00; B65H 2405/1116; B65H 2405/114; B65H 2405/113; B65H 2405/112; B65H 2511/12
See application file for complete search history.

(56) References Cited

U.S. PATENT DOCUMENTS 7,540,494 B2 * 6/2009 Stemmle ..... B65H 1/04 271/171
7,926,804 B2 * 4/2011 Chinzei ..... B65H 31/02 271/162
8,342,515 B2 * 1/2013 Iwata ..... B65H 3/0669 271/248
8,941,849 B2 * 1/2015 Ohtsuka ..... B65H 85/00 399/370
2006/0017217 A1 * 1/2006 Maeda ..... B41J 29/13 347/108
2007/0003355 A1 * 1/2007 Connors ..... B41J 13/103 400/693

(Continued)

FOREIGN PATENT DOCUMENTS

JP 2012046313 A 3/2012

*Primary Examiner* — Thomas A Morrison
(74) *Attorney, Agent, or Firm* — CANON U.S.A., INC. IP Division

(57) ABSTRACT

A feeding device to transport a recording medium includes a main body having a drive source, a tray that is rotatably attached to the main body and on which the recording medium is to be loaded, a handling mechanism provided on the tray, an operation arm portion attached to the main body, and an operation lever provided on the tray so as to face the operation arm portion. The handling mechanism handles the recording medium. The operation arm portion moves in one direction along a rotation axis of the tray by a driving force from the drive source. The operation arm portion moves in the one direction so that the operation arm portion abuts on the operation lever and transmits the driving force to the operation lever so that the operation lever is pushed. The driving force received by the pushed operation lever is transmitted to the handling mechanism.

26 Claims, 13 Drawing Sheets

(56) References Cited

U.S. PATENT DOCUMENTS

| | | | | |
|---|---|---|---|---|
| 2012/0187622 | A1* | 7/2012 | Kamichi | B65H 3/44 271/171 |
| 2013/0328960 | A1* | 12/2013 | Sugawara | B65H 31/02 347/16 |
| 2014/0070482 | A1* | 3/2014 | Matsumoto | B65H 7/00 271/162 |
| 2021/0099591 | A1* | 4/2021 | Arakawa | H04N 1/00602 |

* cited by examiner

FEEDING DEVICE

BACKGROUND

Field

The present disclosure relates to a feeding device that transports a recording medium such as a recording paper.

Description of the Related Art

Examples of a feeding device having a function of transporting a recording medium such as a recording paper include a printer, a copier, and a facsimile. The feeding device is provided with a tray on which a recording medium is stacked, and the tray is provided with a handling mechanism for handling variously the recording medium. The handling mechanism includes a paper guide mechanism that aligns a position of the recording medium with a side guide in a direction orthogonal to a transport direction and separates the side guide from the recording medium as necessary, and a paper alignment mechanism that aligns a stacking position of a discharged recording medium. In order to fold the tray and accommodate it in a main body of a paper feeding device when not in use, the tray is rotatably attached to the main body of the feeding device, and a driving force is transmitted to the handling mechanism from the main body of the feeding device. Japanese Patent Application Laid-Open No. 2012-46313 discloses a sheet supply tray on which a recording medium to be fed is placed in a main body of a feeding device, which is provided with a paper guide mechanism and a separation mechanism.

In Japanese Patent Application Laid-Open No. 2012-46313, a driving force is transmitted to a handling mechanism by a first gear attaching a tray to the main body of the feeding device and provided coaxially with a rotation axis and a second gear provided on the tray side and engaging with the first gear. In this adaptation, the handling mechanism also moves because the second gear rotates due to a change in an opening angle of the tray with respect to the main body of the feeding device, and as a result, the handling mechanism may not operate stably.

SUMMARY

Disclosed are embodiments of a feeding device that transports a recording medium. In an example, the feeding device allows a handling mechanism provided on a tray to operate stably, even when an angle of the tray with respect to a main body of the feeding device changes without disturbing a storage of the tray in the main body of the feeding device.

According to an aspect of the present disclosure, a feeding device to transport a recording medium includes a main body having a drive source, a tray that is rotatably attached to the main body and on which the recording medium is to be loaded, a handling mechanism provided on the tray and configured to handle the recording medium, an operation arm portion attached to the main body and configured to move in one direction along a rotation axis of the tray by a driving force from the drive source, and an operation lever provided on the tray so as to face the operation arm portion, wherein the operation arm portion moves in the one direction so that the operation arm portion abuts on the operation lever and transmits the driving force to the operation lever so that the operation lever is pushed, and wherein the driving force received by the pushed operation lever is transmitted to the handling mechanism.

Further features of the present disclosure will become apparent from the following description of exemplary embodiments with reference to the attached drawings.

DESCRIPTION OF THE EMBODIMENTS

Next, an embodiment of the present disclosure will be described with reference to the drawings. Here, it is assumed that a feeding device that transports a recording medium such as a recording paper is an ink jet recording apparatus that is a printer ejecting a recording liquid (for example, ink) on the recording medium to perform recording. As a matter of course, the feeding device is not limited to the ink jet recording apparatus, and may be a copier, and a facsimile. All of the feeding devices based on the present disclosure are provided with a tray such as a paper feed tray and a paper discharge tray that are attached to the main body of the feeding device and loaded with the recording medium and these trays are provided with a handling mechanism for handling the recording medium. The tray is adapted to be stored when not in use, so that the tray is attached to the main body of the feeding device by a rotating hinge mechanism, which is the simplest and most stable mechanism. The handling mechanism includes, for example, a paper guide mechanism that aligns a position of the recording medium with a side guide in a direction orthogonal to a transport direction and separates the side guides from the recording medium as necessary, and a paper alignment mechanism that aligns a stacking position of a discharged recording medium. It is possible to provide an actuator such as a motor and a solenoid on the tray itself in order to operate the handling mechanism, but in that case, the cost increases. Therefore, the feeding device of the present embodiment is adapted so that the driving force is transmitted from the drive source provided inside the main body of the feeding device to the handling mechanism via a drive transmission mechanism. The drive transmission mechanism is required to be able to transmit the driving stably force to the tray side regardless of the opening angle of the tray attached by the rotating hinge mechanism. The drive transmission mechanism described here satisfies such a requirement.

First Embodiment

Figure 1A:
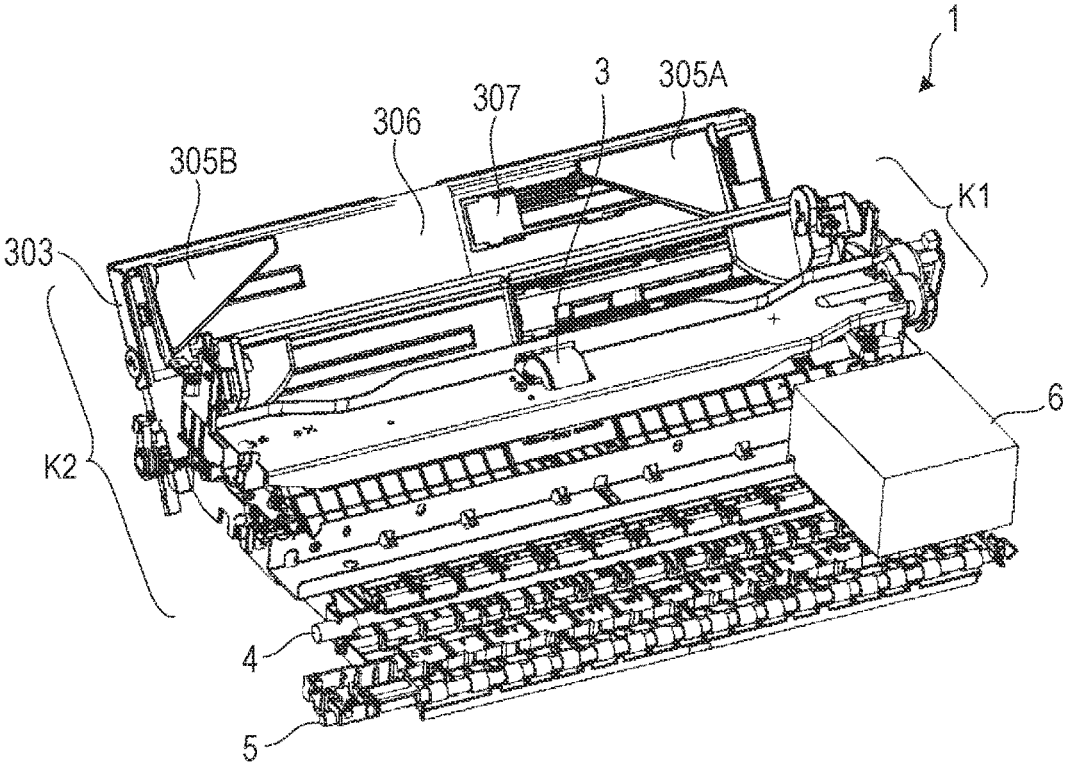
FIG. 1A is a perspective view illustrating an ink jet recording apparatus according to a first embodiment of the present disclosure.
Figure 1B:
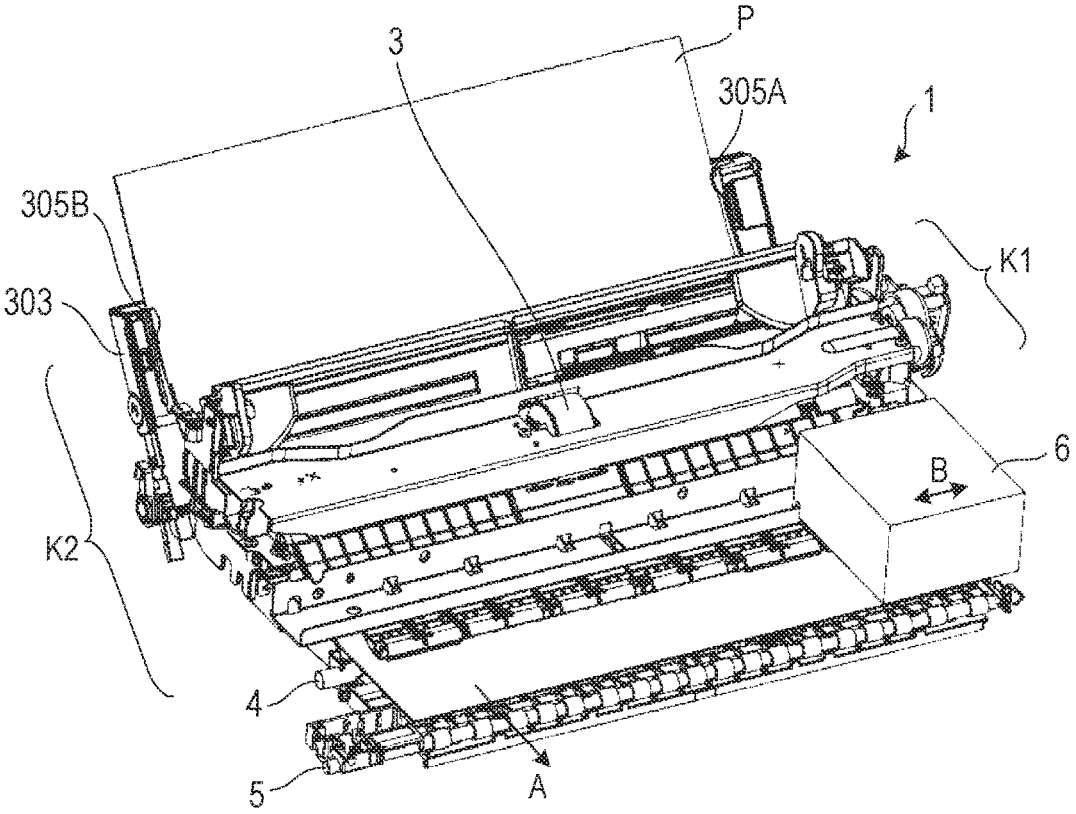
FIG. 1B is a perspective view illustrating an ink jet recording apparatus according to the first embodiment of the present disclosure.
Figure 2:
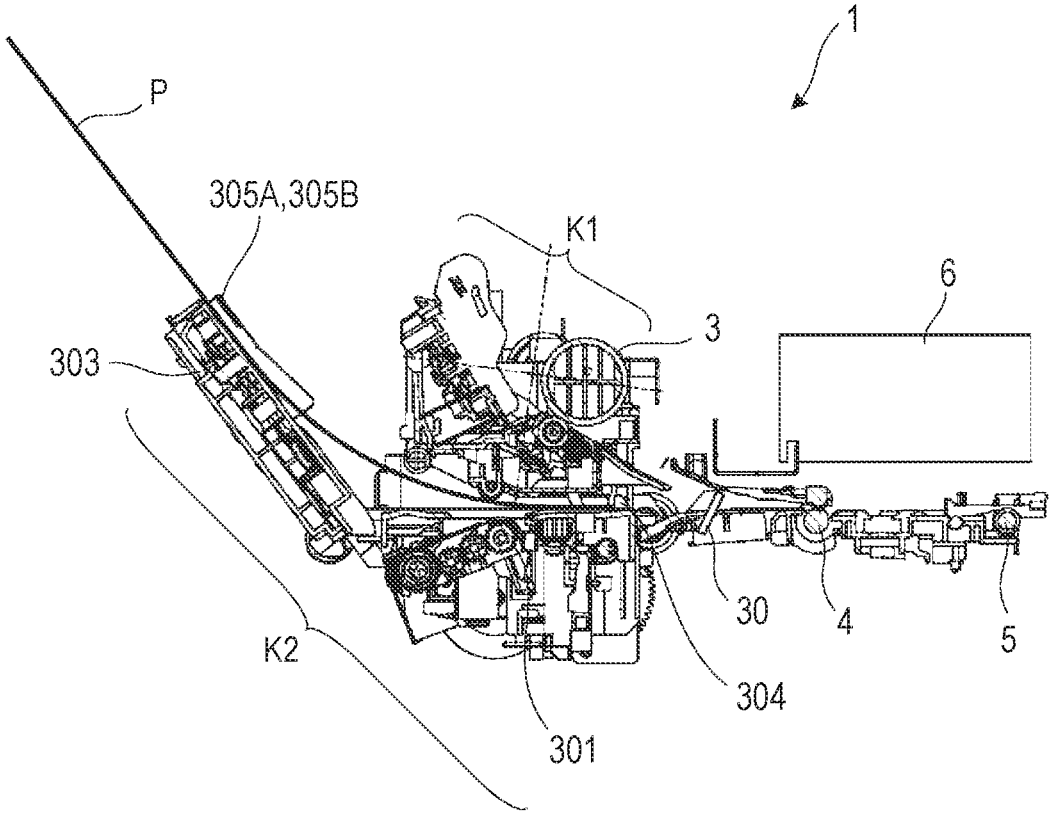
FIG. 2 is a cross-sectional view of the ink jet recording apparatus in a state where a recording medium is transported.

FIGS. 1A and 1B are perspective views illustrating an ink jet recording apparatus 1 according to a first embodiment. FIG. 1A illustrates a main part of the ink jet recording apparatus 1, and FIG. 1B illustrates a state where a recording medium P is transported from a second paper feed unit K2 for recording. FIG. 2 is a cross-sectional view of the main part of the ink jet recording apparatus 1 when the recording medium P is transported. The first embodiment describes a case where a paper feed tray 303 is provided with a paper guide mechanism as a handling mechanism.

The ink jet recording apparatus 1 is provided with an ink jet recording head 6 that ejects a recording liquid on the recording medium P while reciprocating in the direction of arrow B illustrated in FIG. 1B. The ink jet recording apparatus 1 is provided with two paper feed units K1 and K2 in order to store the recording medium P to be transported to a region where recording is performed by the ink jet recording head 6. The first paper feed unit K1 is suitable for a relatively thin recording medium, and the second paper feed unit K2 is provided to feed the recording media P, which cannot be fed from the first paper feed unit K1 such as thick paper, one by one. A first paper feed roller 3 is provided to transport the recording medium P loaded on the first paper feed unit K1 to the inside of the ink jet recording apparatus 1. Similarly, a second paper feed roller 301 (FIG. 2) is provided to transport the recording medium P loaded on the second paper feed unit K2 to the inside of the ink jet recording apparatus 1. A first transport roller pair 4 and a second transport roller pair 5 are provided in order to further transport the recording medium P transported to the inside of the ink jet recording apparatus 1 in the direction of arrow A illustrated in FIG. 1B. The transport direction A of the recording medium P and the reciprocating movement direction B of the ink jet recording head 6 are substantially orthogonal to each other. The region between the first transport roller pair 4 and the second transport roller pair 5 is a region where recording is performed on the recording medium P by the ink jet recording head 6. A medium detection sensor 30 (FIG. 2) for detecting whether or not the recording medium P is present in a transport path is provided on the recording medium P at a position immediately upstream of the first transport roller pair 4 in the transport path. The user of the ink jet recording apparatus 1 selects and uses either the first paper feed unit K1 or the second paper feed unit K2 according to the type, paper quality, size, thickness, hardness of the recording medium P to be used.

In a case where the user records on a desired recording medium P, the desired recording medium P is set in one of the paper feed units K1 and K2. Here, it is assumed that the recording medium P to be recorded is set in the second paper feed unit K2. After setting the recording medium P in the second paper feed unit K2, the user operates a computer connected to the ink jet recording apparatus 1 to supply a signal for recording to the ink jet recording apparatus 1. In response to this signal, the paper feed roller 301 of the second paper feed unit K2 rotates to transport the recording medium P in the direction A illustrated in the FIG. 1B. Furthermore, the recording medium P is transported below a moving region of the ink jet recording head 6 by the first transport roller pair 4. The ink jet recording head 6 ejects the recording liquid in the direction of the recording medium P while reciprocating in the direction of arrow B in FIG. 1B by a guide unit and a driving unit (not illustrated). An image of the recording liquid is formed on the surface of the recording medium P by alternately repeating the transport of the recording medium P by the first transport roller pair and the ejection of the recording liquid by the ink jet recording head 6. When the recording medium P reaches the position of the second transport roller pair 5, the recording medium P is discharged to the paper discharge tray (not illustrated) by the second transport roller pair 5, and as a result, the recording operation on the recording medium P ends. Here, the case where the recording medium P set in the second paper feed unit K2 is transported for recording is described, and processing of transporting the recording medium P set in the first paper feed unit K1 for recording is also performed in the same manner.

Figure 3A:
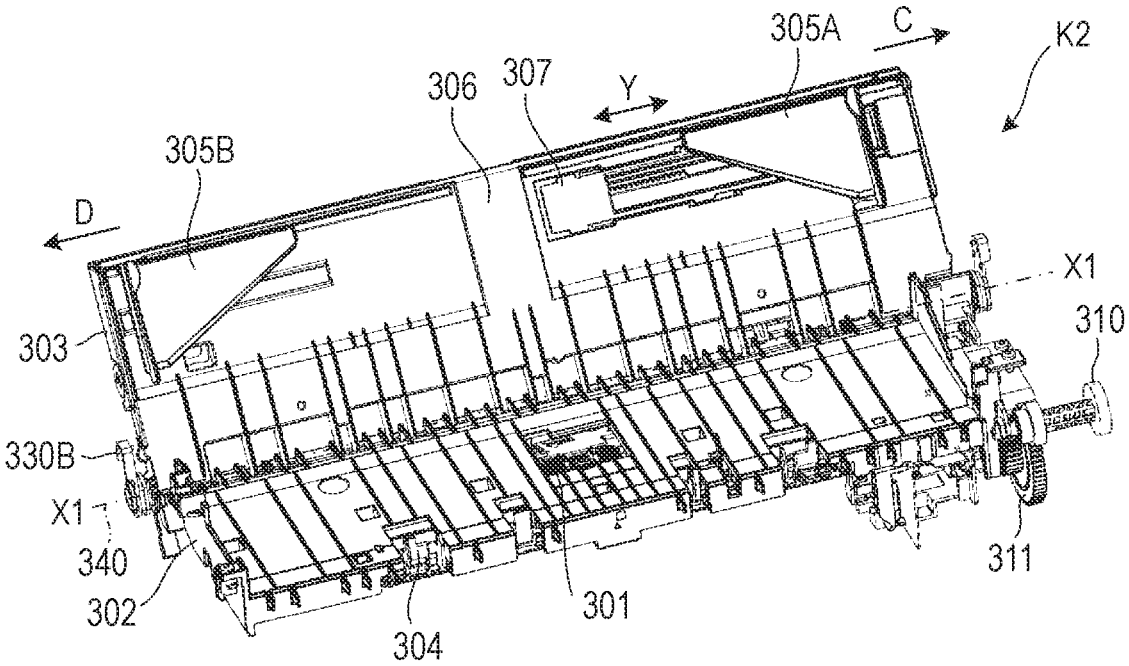
FIG. 3A is a view for describing a second paper feed unit.
Figure 3B:
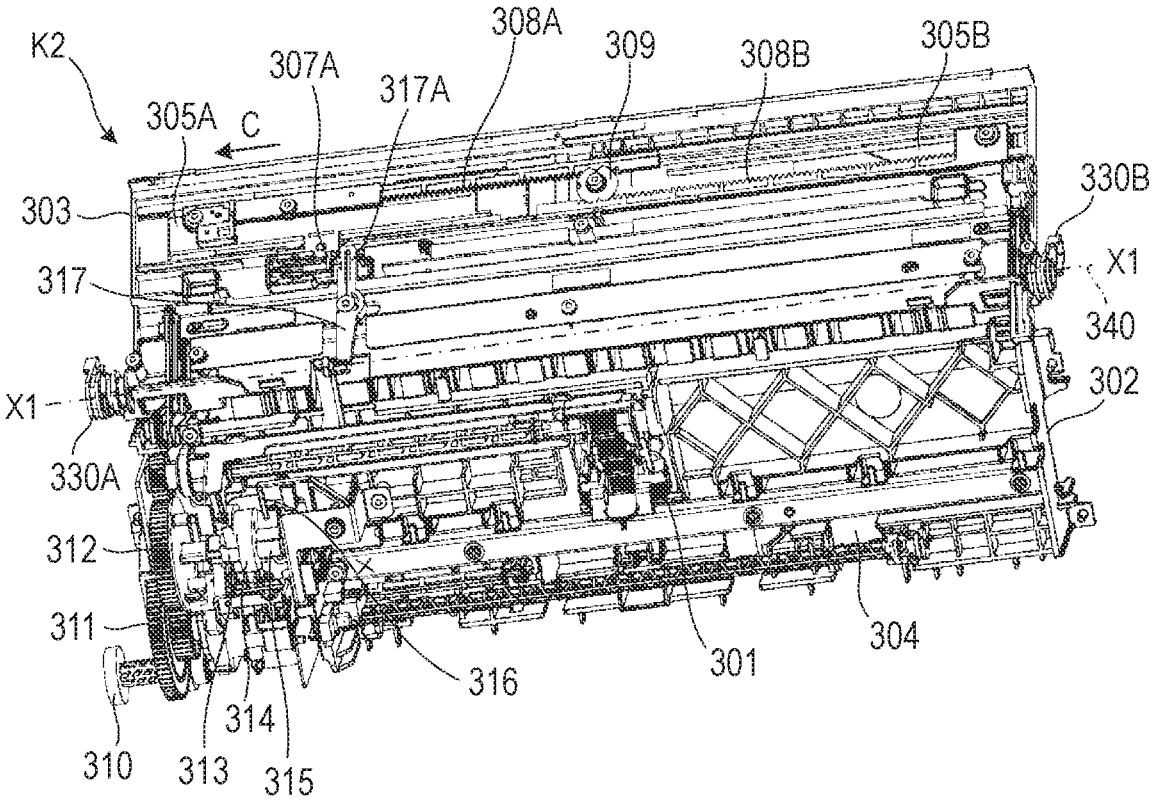
FIG. 3B is a view for describing the second paper feed unit.
Figure 4A:
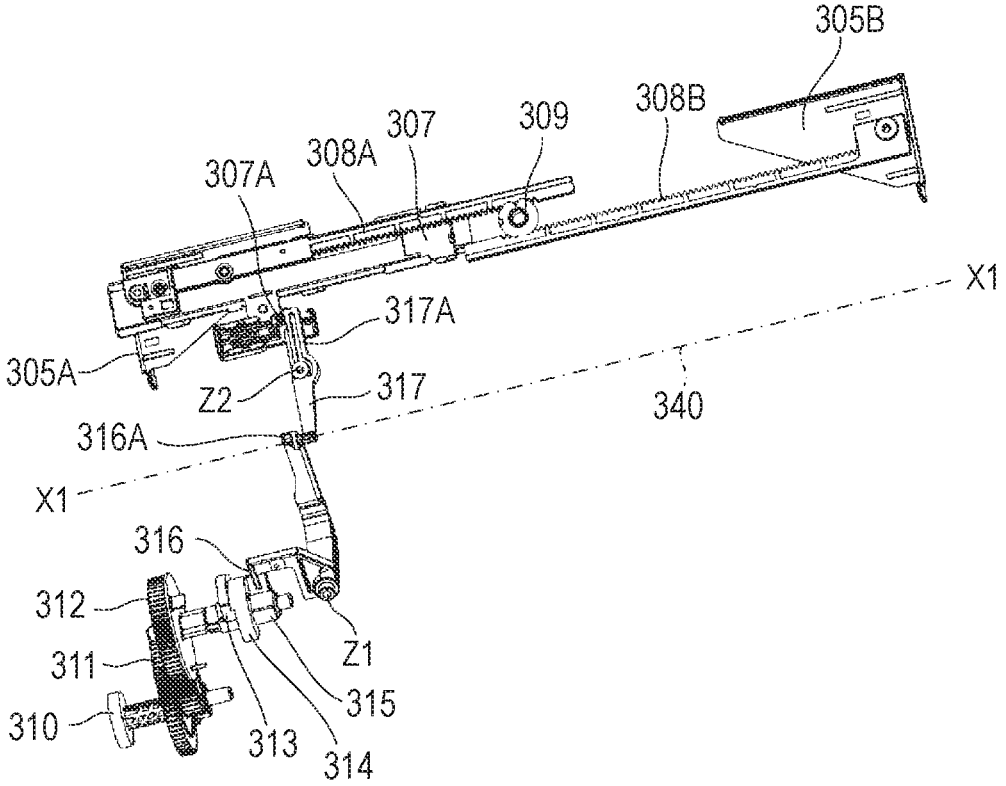
FIG. 4A is a detailed view illustrating a drive transmission mechanism.
Figure 4B:
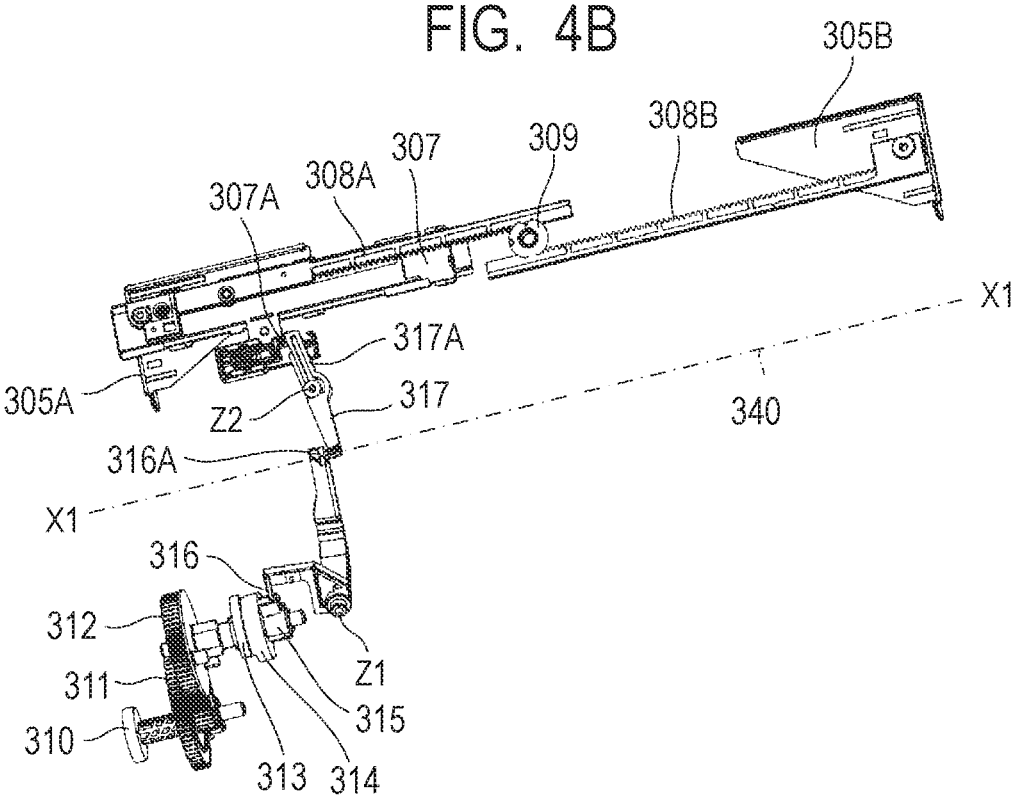
FIG. 4B is a detailed view illustrating the drive transmission mechanism.

Next, the paper feed units K1 and K2 will be described. Since the first paper feed unit K1 and the second paper feed unit K2 have the same configuration, the details of the configuration of the second paper feed unit K2 will be described here. FIGS. 3A and 3B are views illustrating the second paper feed unit K2. FIG. 3A is a perspective view, and FIG. 3B is a bottom view. FIGS. 4A and 4B are views illustrating the drive transmission mechanism in detail. FIG. 4A illustrates a state where side guides 305A and 305B described later are relatively closed, and FIG. 4B illustrates a state where the side guides 305A and 305B are relatively open.

The second paper feed unit K2 is adapted to include a base 302 and a rear tray 303 which is a paper feed tray. The base 302 is a member belonging to the main body of the ink jet recording apparatus 1. The base 302 is provided with the above-described paper feed roller 301 that transports the recording medium P in the direction A, and a stopper 304 that abuts a leading edge of the recording medium P to determine a leading edge position, when setting the recording medium P in the second paper feed unit K2. Since the recording medium P is loaded, the rear tray 303 is required to project from a main body portion of the ink jet recording apparatus 1 to a rear surface side when the ink jet recording apparatus 1 is used, and the rear tray 303 cannot project when not in use. Therefore, the rear tray 303 is rotatably attached to the base 302 via a pair of rotating hinges 330A and 330B so that the rear tray 303 can be folded and stored on the main body portion side of the ink jet recording apparatus 1 when not in use. In the drawing, the line X1-X1 illustrates a rotation axis 340 of the rear tray 303 with respect to the base 302.

The rear tray 303 is provided with a pair of side guides 305A and 305B that are for regulating the positions on both sides of the recording medium P when the recording medium P is set as a mechanism for handling the recording medium P loaded thereon. The side guides 305A and 305B are provided corresponding to a pair of recording media P, that is, sides, which are both edge portions in a direction orthogonal to the transport direction A, respectively. By interposing a pair of sides of the recording medium P by the side guides 305A and 305B, the recording medium P in the second paper feed unit K2 is positioned at a predetermined position. It is necessary that an interval between the side guides 305A and 305B can be changed depending on the size of the recording medium P. Therefore, a rear tray guide 306 is provided with a shift member 307 that is movable in the direction of the arrow Y in FIG. 3A on the surface of the rear tray 303 on which the recording medium P is loaded. The side guide 305A is attached to the shift member 307 via a friction member (not illustrated) so that the position in the direction Y with respect to the shift member 307 can be regulated. The friction member is adapted to apply an appropriate sliding load when the user manually moves the side guide 305A in the direction Y to regulate the interval, and to fix the side guide 305A to the shift member 307 when the user releases the side guide 305A.

A rack member 308A having a rack gear is fixed to the rear surface of the side guide 305A. The side guide 305B is provided so as to be movable in the direction Y in FIG. 3A with respect to the rear tray guide 306, and a rack member 308B having a rack gear is fixed to the side guide 305B. A pinion gear 309 is provided between the rack member 308A and the rack member 308B, the pinion gear 309 and the rack member 308A mesh with each other, and the pinion gear 309 and the rack member 308B also mesh with each other. As a result, when the user moves the side guide 305A in the direction Y by the hand thereof, the side guide 305B moves in the direction opposite to the direction Y. Similarly, when the user moves the side guide 305B in the direction Y, the side guide 305A moves in the direction opposite to the direction Y. The user can regulate the interval between the side guides 305A and 305B according to the size of the recording medium P to be used.

The base 302 is provided with an input gear 310 for inputting a driving force supplied from the main body portion of the ink jet recording apparatus 1 to drive the second paper feed unit K2. The input driving force is transmitted from the input gear 310 to a main cam gear 312 via an idler gear 311. As illustrated in FIG. 3B, a first cam 313, a second cam 314, and a third cam 315 are fixed on the same axis as that of the main cam gear 312, and are each involved in a roller separation operation, a stopper opening and closing operation, and a side guide separation operation described later. The rotation axis of the main cam gear 312 is parallel to the rotation axis 340, that is, the line X1-X1. A cam follower 316 abuts on a third cam 315. As illustrated in FIGS. 4A and 4B, the cam follower 316 is rotatable about a shaft Z1. The other end of the cam follower 316 is an operation arm portion 316A, and the operation arm portion 316A faces an operation lever 317 on the axis X1-X1 which is the rotation axis 340 of the rear tray 303. The operation lever 317 is rotatable about a rotation shaft Z2, the other end of the operation lever 317 is an arm 317A with the rotation shaft Z2 interposed therebetween, and the arm 317A faces an abutting portion 307A of the shift member 307. Here, the shaft Z1 and the shaft Z2 are both shafts orthogonal to the rotation axis 340.

Figure 5A:
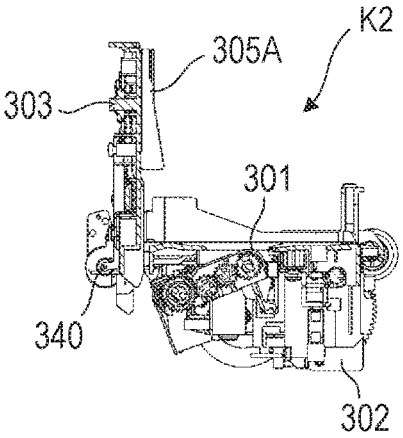
FIG. 5A is a cross-sectional view illustrating a set state of a rear tray.
Figure 5B:
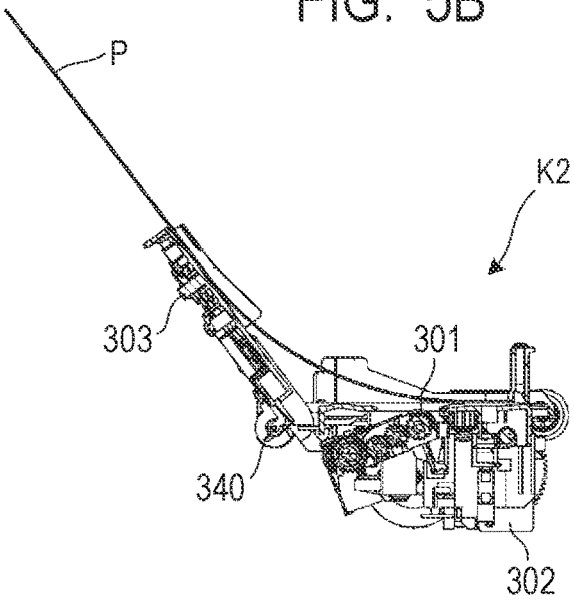
FIG. 5B is a cross-sectional view illustrating the set state of the rear tray.
Figure 5C:
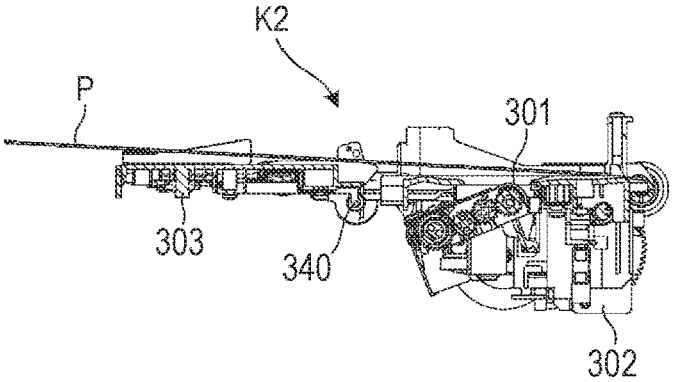
FIG. 5C is a cross-sectional view illustrating the set state of the rear tray.
Figure 5D:
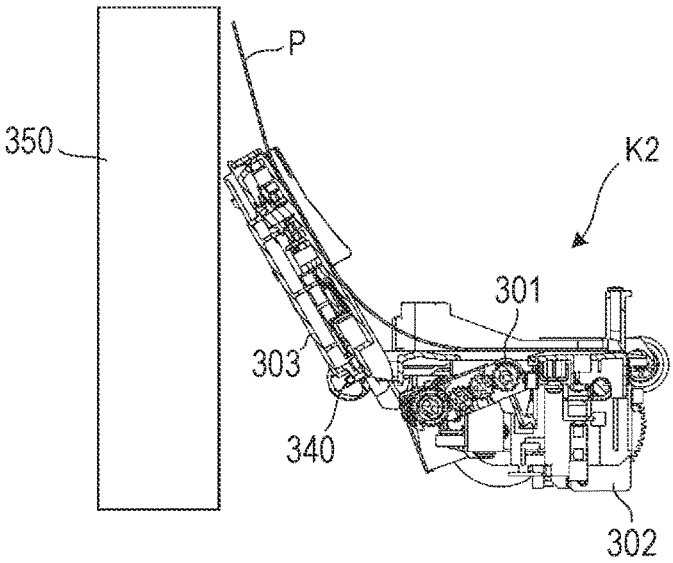
FIG. 5D is a cross-sectional view illustrating the set state of the rear tray.

FIGS. 5A, 5B, 5C, and 5D are cross-sectional views illustrating various set states according to the usage state of the rear tray 303. The rear tray 303 is attached to the base 302 so that the rear tray 303 can rotate about the rotation axis 340. FIG. 5A illustrates a state where the rear tray 303 is stored in the main body portion of the ink jet recording apparatus 1 when the ink jet recording apparatus 1 is not in use, and the rear tray 303 is fixed in an upright state. FIG. 5B illustrates a state where the rear tray 303 is opened for use of the ink jet recording apparatus 1. In order to facilitate positioning of the leading edge position of the recording medium P, the rear tray 303 is in an inclined state where the rear tray 303 is lowered toward the main body side of the ink jet recording apparatus 1. Depending on the type of recording medium P such as thick paper, the rear tray 303 can be horizontal. FIG. 5C illustrates a state where the rear tray 303 is horizontal. The rear tray 303 is provided with a fixing unit (not illustrated) capable of fixing the rear tray 303 in a horizontal posture. The fixing unit fixes the angle of the rear tray 303 with respect to the main body of the ink jet recording apparatus 1 around the rotation axis 340 to a predetermined angle. The fixing unit may be adapted so that the rear tray 303 can be fixed in a posture other than the horizontal state, and the rear tray 303 may be fixed at any of a plurality of angles. By fixing the rear tray 303 in a horizontal state, the ink jet recording apparatus 1 can record and discharge even a recording medium having high rigidity without bending. By fixing the rear tray 303 in the horizontal state, the recording medium P is transported in the horizontal direction without being bent. FIG. 5D illustrates a state where an obstacle 350 such as a wall on the rear surface side of the ink jet recording apparatus 1 interferes with the rear tray 303. In a case where the ink jet recording apparatus 1 is installed in a narrow place, the rear tray 303 cannot be opened at a regular angle as illustrated in FIG. 5B, and the rear tray 303 may be opened only in an incomplete state as illustrated in FIG. 5D. According to the usage state of the rear tray 303, the side guides 305A and 305B, which are handling mechanisms, may be operated normally and stably even in an incomplete state as illustrated in FIG. 5D.

Figure 6:
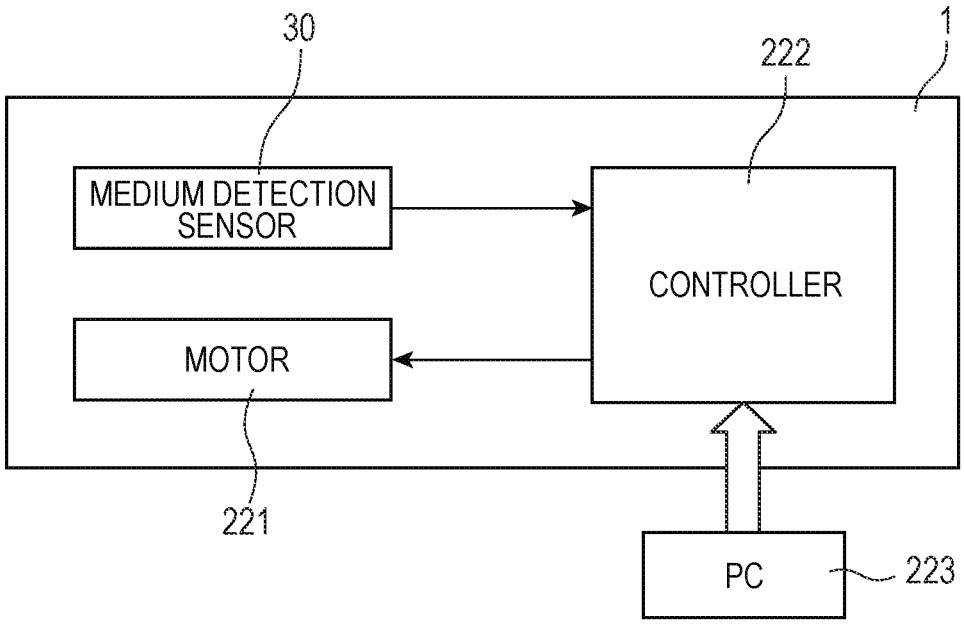
FIG. 6 is a block diagram illustrating a configuration of a control unit of the ink jet recording apparatus.

Next, a control unit provided in the ink jet recording apparatus 1 for driving one of the side guides 305A and 305B or each of the rollers will be described. FIG. 6 is a block diagram illustrating the configuration of the control unit. The ink jet recording apparatus 1 is provided with a medium detection sensor 30 and a motor 221 as a drive source, and is further provided with a controller 222 for inputting a detection result of the medium detection sensor 30 and controlling the motor 221. The controller 222 is connected to a personal computer (PC) 223, which is a higher-level device for the ink jet recording apparatus 1. Various signals for recording are supplied from the PC 223 to the ink jet recording apparatus 1.

Figure 7A:
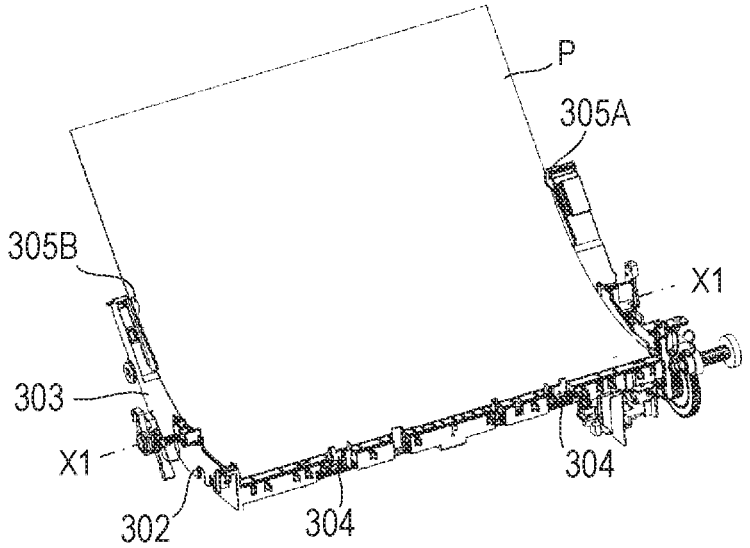
FIG. 7A is a perspective view for describing transport of the recording medium via the second paper feed unit.
Figure 7B:
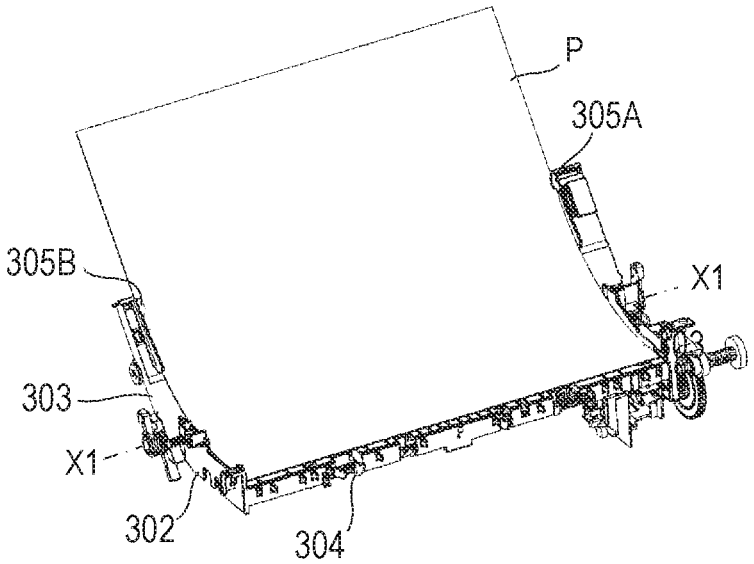
FIG. 7B is a perspective view for describing the transport of the recording medium via the second paper feed unit.
Figure 7C:
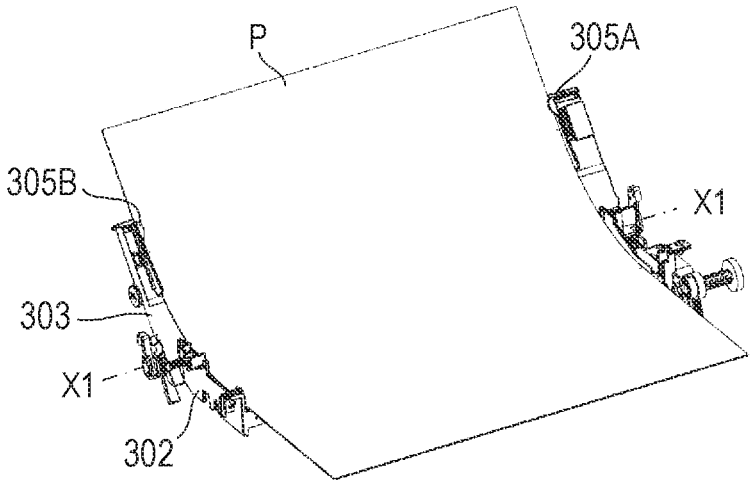
FIG. 7C is a perspective view for describing the transport of the recording medium via the second paper feed unit.
Figure 8:
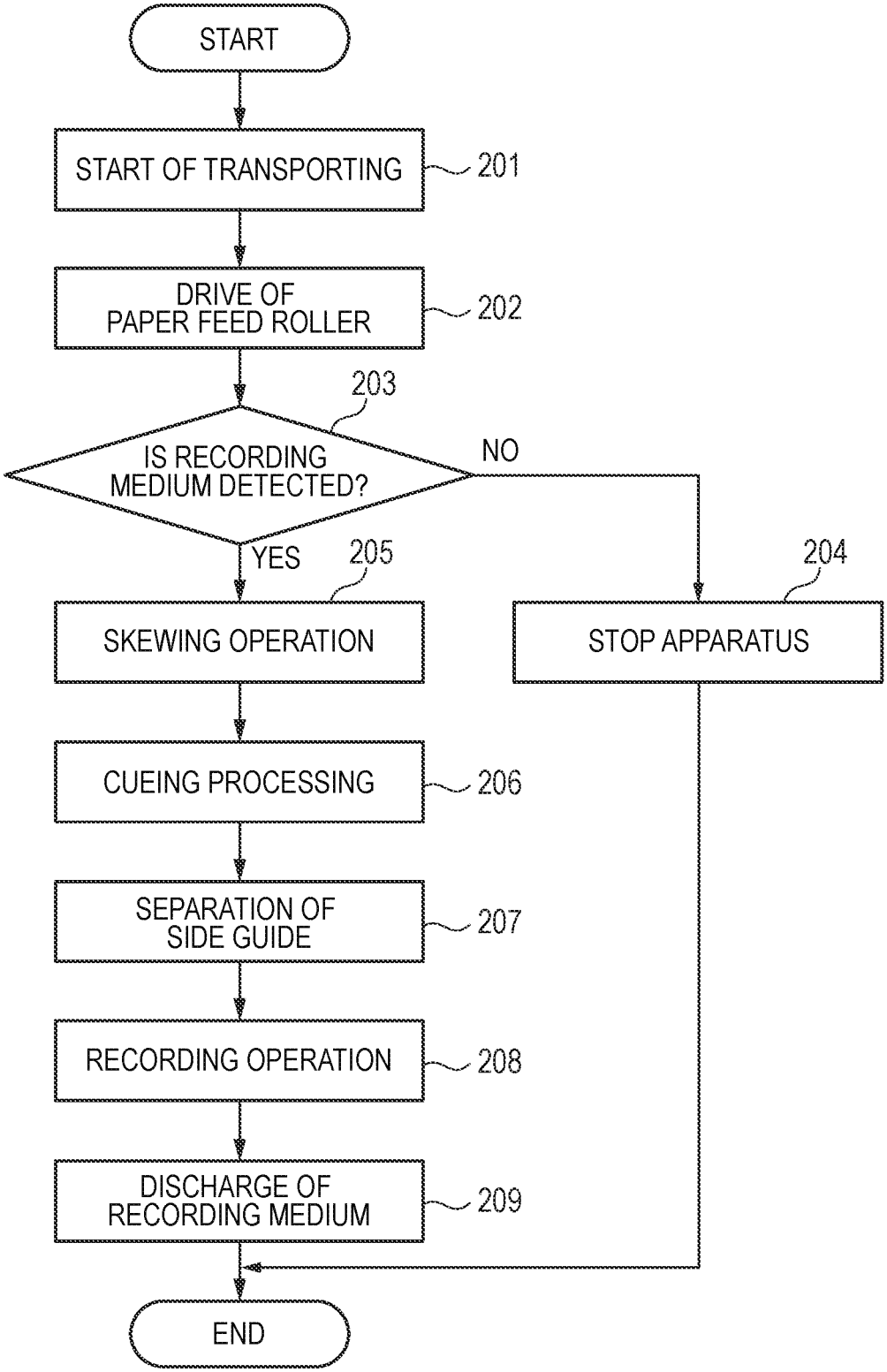
FIG. 8 is a flowchart illustrating an operation of the ink jet recording apparatus.

Hereinafter, an operation of the ink jet recording apparatus 1 according to the first embodiment will be described. FIGS. 7A, 7B, and 7C are perspective views for describing the transport of the recording medium P via the second paper feed unit K2. FIG. 7A illustrates a state where the recording medium P is set, FIG. 7B illustrates a state at the start of transport, and FIG. 7C illustrates a state during transport. In addition, FIG. 8 is a flowchart for describing an operation control of the ink jet recording apparatus 1 by the controller 222. In a case where the second paper feed unit K2 is used, the user opens the rear tray 303 as illustrated in FIG. 5B, and then widens the interval between the side guides 305A and 305B from the width of the recording medium P. The user inserts a bundle of the recording medium P into the second paper feed unit K2 from the inclined rear tray 303 and abuts the bundle of the recording medium P against the stopper 304 at the abutting position. Furthermore, the user moves one of one and both of the side guides 305A and 305B toward the recording medium P by moving the side guides 305A and 305B and sets the recording medium P by interposing both edges of the recording medium P with a pair of side guides 305A and 305B. In the present embodiment, since the side guides 305A and 305B are interlocked by the rack members 308A and 308B and the pinion gear 309 as described above, the user may move one of the side guides 305A and 305B. In this state, as illustrated in FIG. 7A, the leading edge of the recording medium P is positioned by the stopper 304 and both edges are positioned by the side guides 305A and 305B and the recording medium P is set at the recording start position. The user manually performs the operations up to this point.

Subsequently, the user operates the PC 223 connected to the ink jet recording apparatus 1 in order to record on the recording medium P and sends a signal instructing the start of the recording operation from the PC 223 to the controller 222. As a result, the controller 222 goes through the execution of the processing illustrated in FIG. 8. First, in step 201, the controller 222 starts a paper feeding operation for transporting the recording medium P into the inside of the ink jet recording apparatus 1, drives the motor 221 (refer to FIG. 6) as a drive source, and rotates the input gear 310. By the rotation of the input gear 310, the driving force is transmitted from the motor 221 to the main cam gear 312 via the idler gear 311, and the first cam 313, the second cam 314, and the third cam 315 fixed to the main cam gear 312 rotate. By these rotations, the stopper 304 is first driven by the second cam 314 to separate from the leading edge of the recording medium P as illustrated in FIG. 7B. As a result, the recording medium P is in a state where the recording medium P can be transported in the direction of arrow A (FIG. 1B). This state is a state of the recording medium P at the start of transport.

Next, the first cam 313 operates, and the paper feed roller 301 separated from the recording medium P abuts on the recording medium P. As a result, as illustrated in step 202, the paper feed roller 301 starts transporting the recording medium P in the direction A. In step 203, the controller 222 determines whether or not the medium detection sensor 30 provided in the transport path is detected the leading edge of the recording medium P. In a case where the leading edge of the recording medium P is not detected even when the paper feed roller 301 is driven by a predetermined amount, in step 204, the controller 222 determines that the device is abnormal, stops the ink jet recording apparatus 1, and ends the processing. When the leading edge of the recording medium P is detected in step 203, the controller 222 then starts a skewing operation of the recording medium P being transported in step 205. The skewing operation is an operation of correcting the direction of the recording medium P so that the sides of the recording medium P are parallel to the transport direction A, when the recording medium P is transported in a state of being inclined to the transport direction A. While the skewing operation is performed, each of the side guides 305A and 305B maintains a state of being in contact with both sides of the recording medium P and come into contact with the recording medium P. As a result, an auxiliary guide operation for correcting the skew of the recording medium P is executed.

There are various types of skewing operations that can be executed in the present embodiment, and an example thereof will be described here. As a matter of course, the skewing operation applicable to the present embodiment is not limited to the operation described here. From the time when the medium detection sensor 30 detects the leading edge of the recording medium P, the second paper feed roller 301 transports the recording medium P in the transport direction A by a certain distance. The certain distance is set to be slightly longer than the distance from the medium detection sensor 30 to the first transport roller pair 4, for example, approximately 4 mm longer. Since the first transport roller pair 4 does not rotate at this point, the leading edge of the recording medium P is blocked between the nips of the first transport roller pair 4 and aligned so as to be parallel to the first transport roller pair 4. Thereafter, the first transport roller pair 4 starts rotating, and as a result, in step 206, the recording medium P of which the side of the leading edge is aligned so as to be parallel to the first transport roller pair 4 is fed out toward the second transport roller pair 5 as illustrated in FIG. 7C. This processing is referred to as cueing.

When the input gear 310 further rotates after the skewing operation, the third cam 315 rotates the cam follower 316 about the shaft (FIGS. 4A, 4B, 10A, and 10B). The operation arm portion 316A at the other end of the cam follower 316 abuts on the operation lever 317 on the rotation axis 340 (axis X1-X1) of the rear tray 303 and pushes the operation lever 317 in the extending direction of the rotation axis 340. The operation lever 317 rotates about the rotation shaft Z2 (FIGS. 4A, 4B, 1A, an 10B) when one end is pushed, and the arm 317A at the other end pushes the abutting portion 307A of the shift member 307. As a result, the shift member 307 is driven in the direction of arrow C in FIG. 3A. The side guide 305A attached to the shift member 307 via a friction member and the rack member 308 attached to the side guide 305A are driven together in the same direction as that of the shift member 307. Since the pinion gear 309 is provided between the rack member 308A and the rack member 308B, the rack member 308B and the side guide 305B are driven in the direction of arrow D in FIG. 3A as the shift member 307 moves. By this operation, in step 207, the side guides 305A and 305B move in the directions of arrows C and D from both edges of the recording medium P, respectively, and are separated from the recording medium P.

Figure 9A:
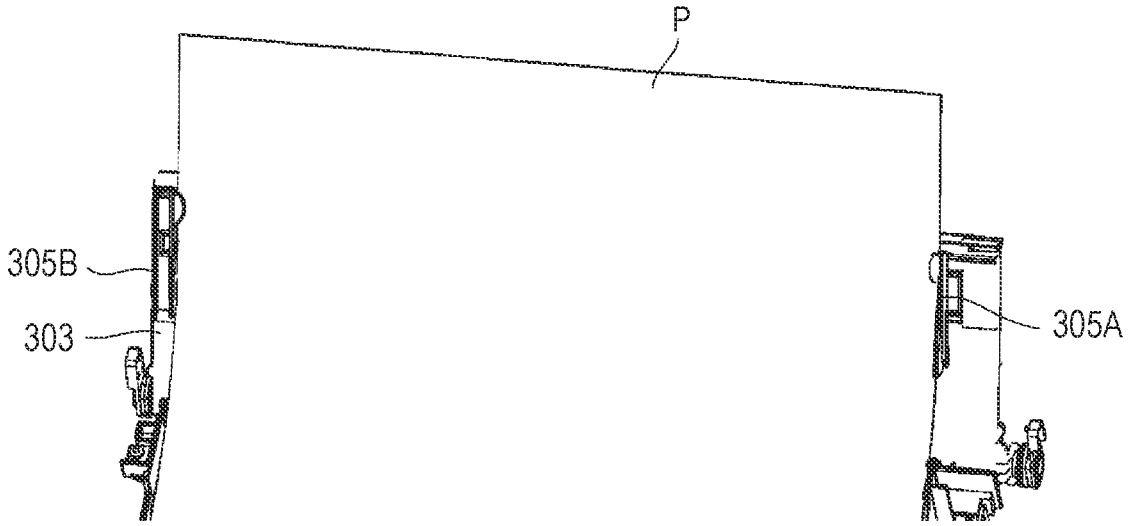
FIG. 9A is a perspective view illustrating a separation of a side guide.
Figure 9B:
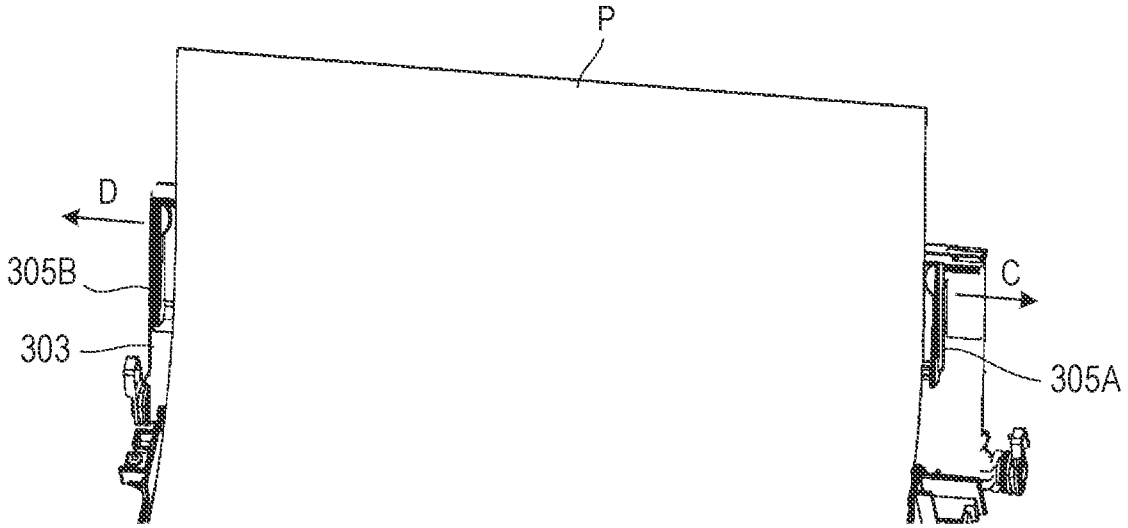
FIG. 9B is a perspective view illustrating the separation of the side guide.
Figure 10B:
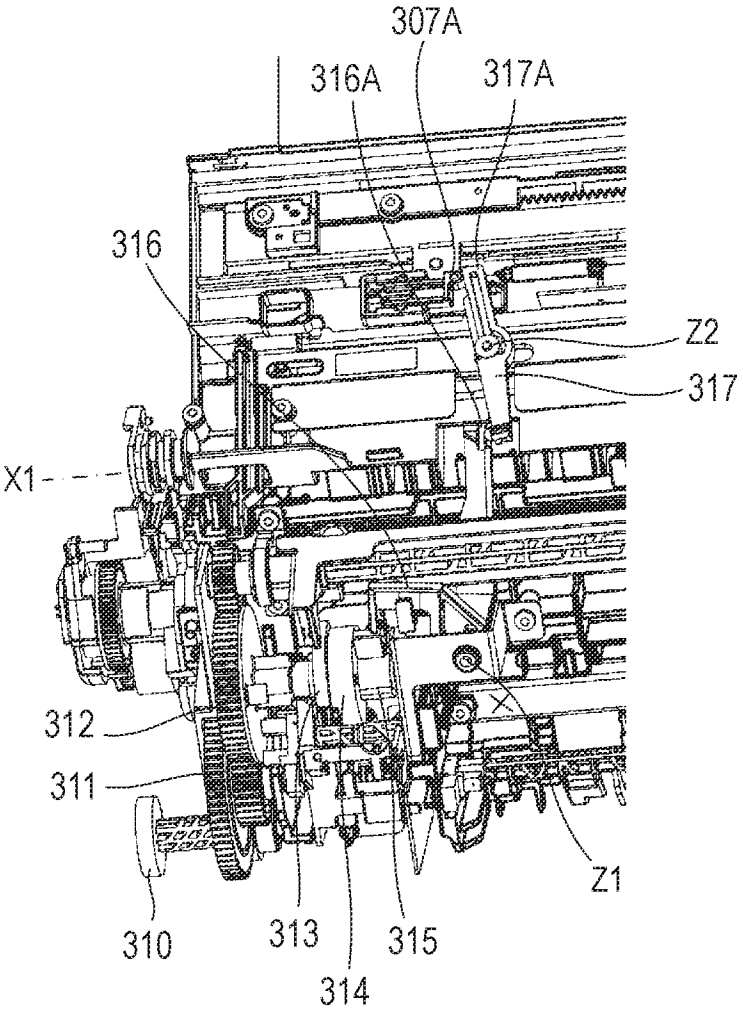
FIG. 10B is a bottom view of the second paper feed unit for describing the drive transmission mechanism.
Figure 10A:
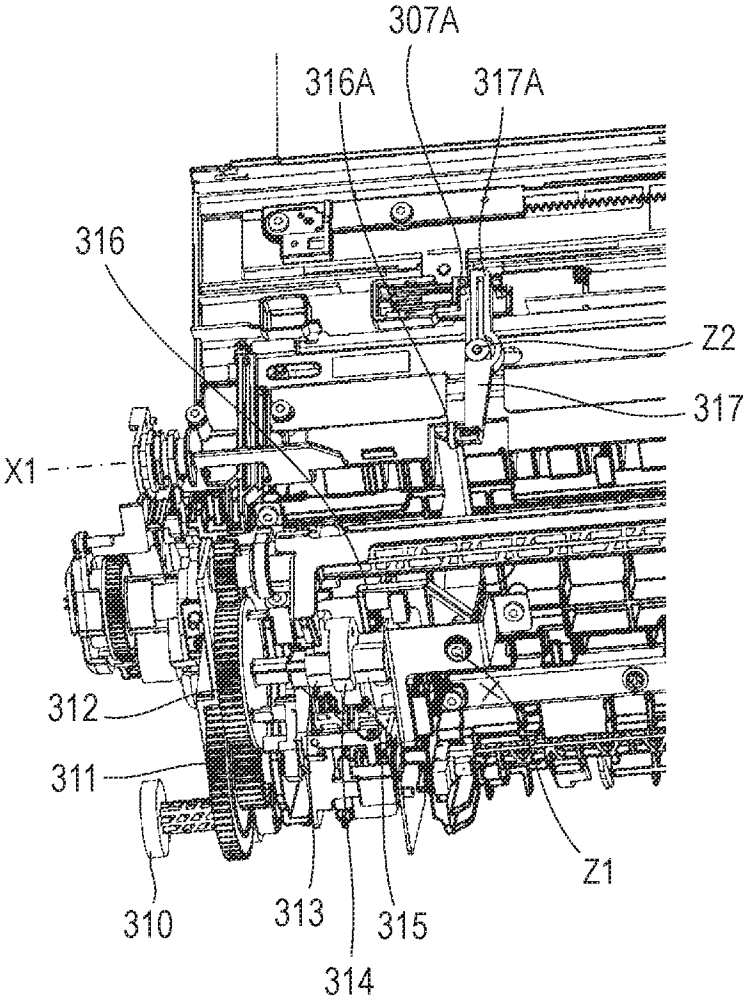
FIG. 10A is a bottom view of the second paper feed unit for describing the drive transmission mechanism.

FIGS. 9A and 9B are a perspective view for describing the separation of the side guides 305A and 305B of the second paper feed unit K2 when viewed from a direction perpendicular to the surface of the transported recording medium P. FIG. 9A illustrates a state where each of the side guides 305A and 305B abuts on both sides of the recording medium P, that is, a state where the side guides 305A and 305B are relatively closed. FIG. 9B illustrates a state where the side guides 305A and 305B are separated from the recording medium P, that is, a state where the side guides 305A and 305B are relatively open. FIGS. 10A and 10B are bottom views of the main part of the second paper feed unit K2 and illustrate the drive transmission mechanism used for separating the side guides 305A and 305B. FIG. 10A illustrates a state where the side guides 305A and 305B are relatively closed, and FIG. 10B illustrates a state where the side guides 305A and 305B are relatively open.

Thereafter, in step 208, the controller 222 executes a recording operation of ejecting the recording liquid from the ink jet recording head 6 on the recording medium P. In the recording operation, ejecting the ink while moving and scanning the ink jet recording head 6 in the direction of arrow B in FIG. 1B by a guide unit and a driving unit (not illustrated), and transporting the recording medium P by the first transport roller pair 4 are alternately repeated. When the recording on the recording medium P is ended, in step 209, the recorded recording medium P is discharged from the ink jet recording apparatus 1, and the operation of a series of devices is ended. In the present embodiment, since the side guides 305A and 305B are separated from the recording medium P during the recording operation, a back tension applied to the transported recording medium P is reduced, and good transport accuracy can be obtained. As a result, the recording liquid can be ejected to the recording medium P with high position accuracy, and good recording can be obtained.

As described with reference to FIGS. 5A, 5B, 5C, and 5D, the rear tray 303 can take various angles around the rotation axis 340. When recording on a normal recording medium P such as plain paper, the rear tray 303 is fixed at the position illustrated in FIG. 5B, and when recording on a recording medium P such as thick paper or hard paper, the rear tray 303 is fixed in a horizontal state as illustrated in FIG. 5C. In the present embodiment, the driving force output from the main body side of the ink jet recording apparatus 1 in order to separate the side guides 305A and 305B is transmitted to the operation lever 317 via the cam follower 316 on the rotation axis 340 in the axial direction of the rotation axis 340. As a result, it is possible to transmit the driving force reliably, regardless of the angle of the rear tray 303 as a movable portion, with respect to the main body portion of the ink jet recording apparatus 1, and the separation operation of the side guides 305A and 305B can be executed in the same manner. As illustrated in FIG. 5D, even in a case where the rear tray 303 cannot be expanded to a normal angle due to restrictions on the installation location of the ink jet recording apparatus 1, the separation operation of the side guides 305A and 305B can be performed in the same manner as at other angles. As a result, according to the present embodiment, it is possible to provide a highly convenient ink jet recording apparatus 1 as one of the feeding devices.

Figure 11A:
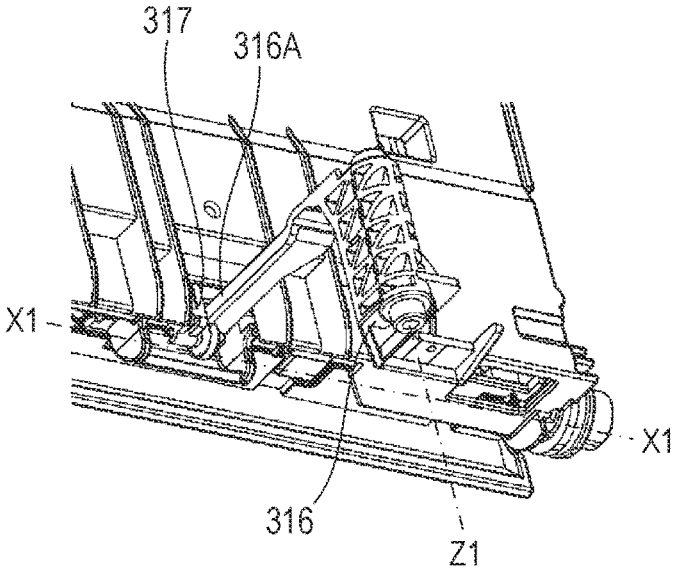
FIG. 11A is a view illustrating an abutting state between an operation arm and an operation lever.
Figure 11B:
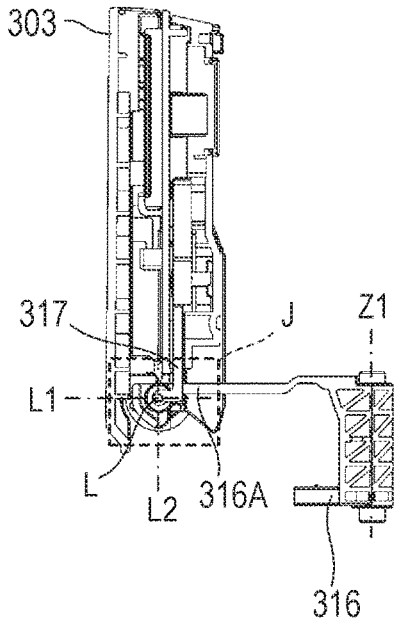
FIG. 11B is a view illustrating the abutting state between the operation arm and the operation lever.

FIGS. 11A and 11B are views illustrating a state of abutting between the operation arm portion 316A at the other end of the cam follower 316 and the operation lever 317. FIG. 11A is an enlarged perspective view illustrating the abutting portion, and FIG. 11B is a side view of the rear tray 303 as viewed from the direction of the rotation axis 340 (axis X1-X1). In the first embodiment, the operation arm portion 316A and the operation lever 317 abut on each other on the rotation axis 340 to transmit a driving force in the form of linear motion. Since these portions abut on each other, even when the operation arm portion 316A and the operation lever 317 rotate relative to each other around the rotation axis 340, the driving force can be transmitted without hindering such relative rotation. In FIG. 11B, the rotation axis 340 is illustrated by a point L which is an intersection of two one-dot chain lines L1 and L2 orthogonal to each other, and at the point L, the operation arm portion 316A at the other end of the cam follower 316 and the operation lever 317 abut on each other. The abutting position between both portions is not required to be exactly on the rotation axis 340 and may be slightly deviated from the rotation axis 340 when both are within the abutting range regardless of the angle of the rear tray 303. That is, in the present embodiment, it is first important that the direction in which the operation arm portion 316A of the cam follower 316 pushes the operation lever 317 coincides with the rotation axis 340.

However, as the abutting position deviates from the rotation axis 340, it is necessary to increase the area of the abutting surface so that the abutting can be performed regardless of the angle of the rear tray 303, which leads to an increase in the size of the ink jet recording apparatus 1. When the position where the operation arm portion 316A abuts on the operation lever 317 is within the range surrounded by a broken line frame J in FIG. 11B, for example, the effect of the present embodiment can be obtained without increasing the size of the ink jet recording apparatus 1.

Second Embodiment

Figure 12A:
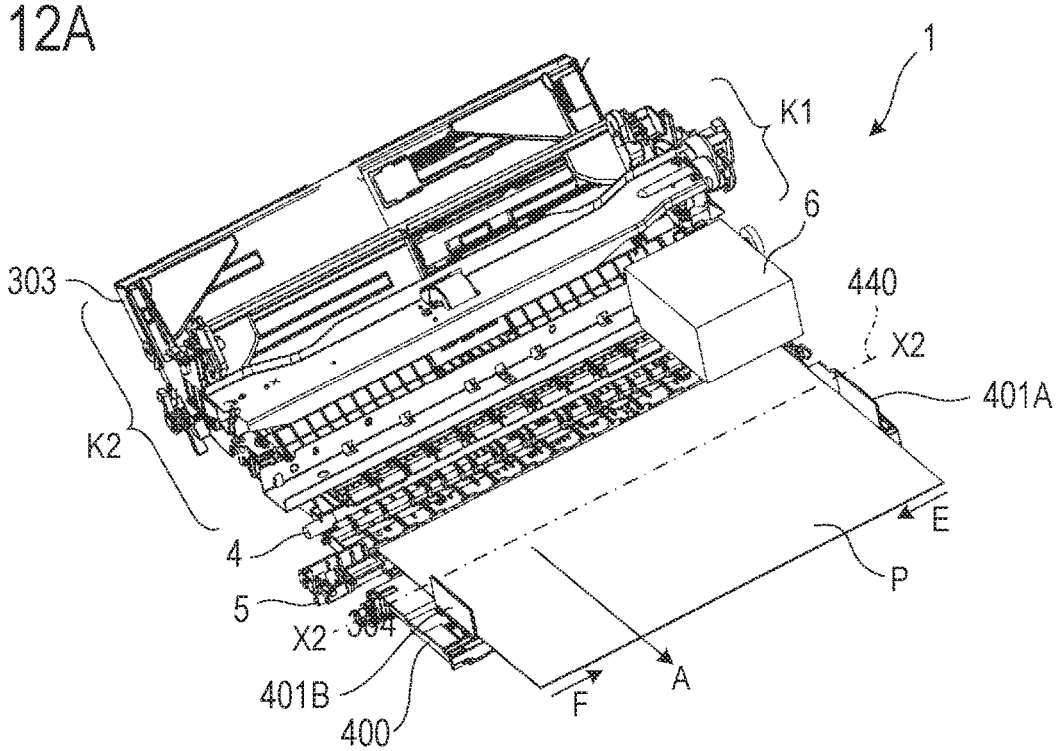
FIG. 12A is a view illustrating an ink jet recording apparatus according to a second embodiment of the present disclosure.
Figure 12B:
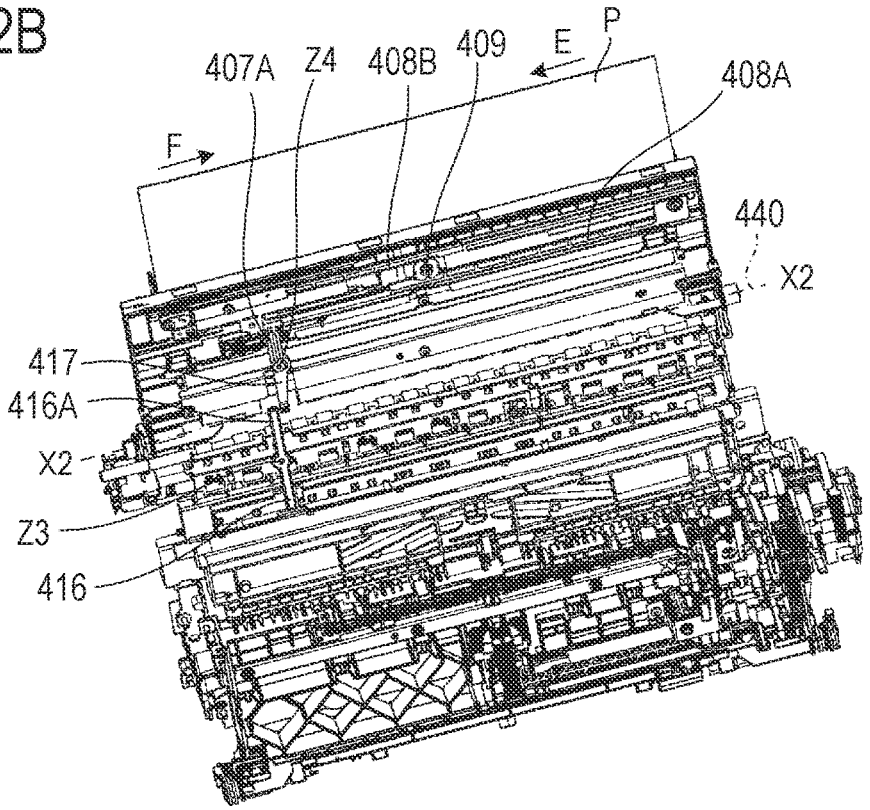
FIG. 12B is a view illustrating the ink jet recording apparatus according to the second embodiment of the present disclosure.
Figure 13A:
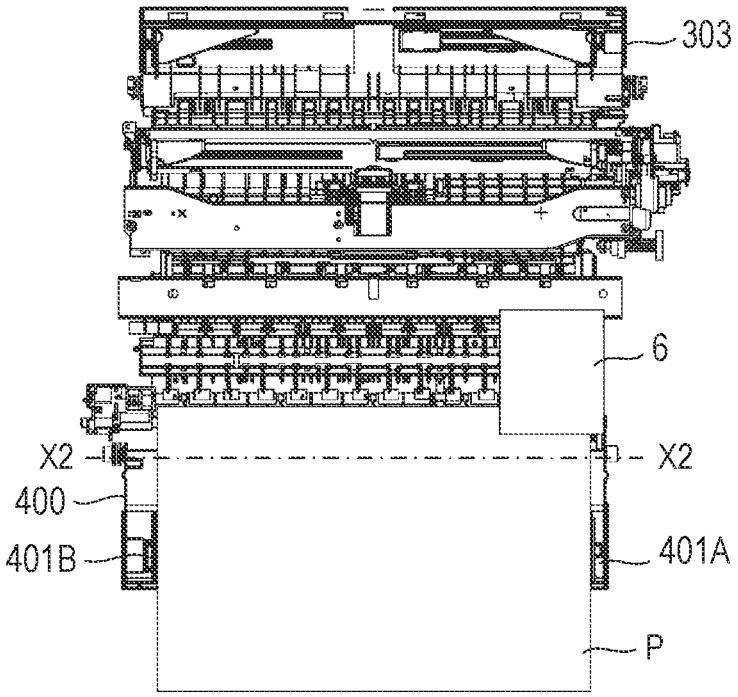
FIG. 13A is a top view illustrating an operation of a paper alignment mechanism.
Figure 13B:
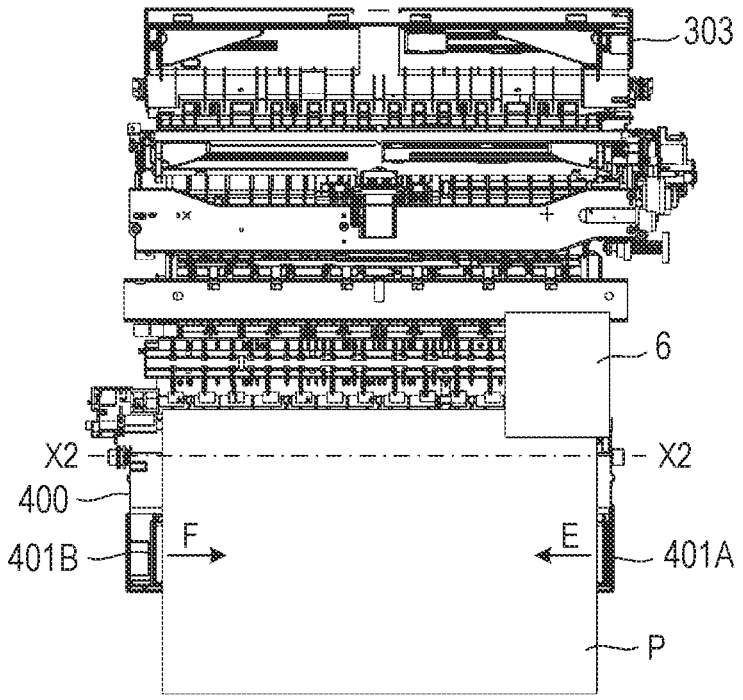
FIG. 13B is a top view illustrating the operation of the paper alignment mechanism.

In the first embodiment, the present disclosure is applied to the paper feed tray in the ink jet recording apparatus 1, and the present disclosure can also be applied to a paper discharge tray in which a recording medium P recorded in the ink jet recording apparatus 1 is discharged and stacked. In the second embodiment, an example in which a paper discharge tray 400 is provided for the same ink jet recording apparatus 1 as in the first embodiment, and the present disclosure is applied to a paper alignment mechanism provided as a handling mechanism on the paper discharge tray 400 will be described. FIGS. 12A and 12B are views illustrating the configuration of the ink jet recording apparatus 1 according to the second embodiment of the present disclosure. FIGS. 12A and 12B are a perspective view and a bottom view of a main part of the ink jet recording apparatus 1, respectively. In addition, FIGS. 13A and 13B are top views illustrating the operation of the paper alignment mechanism provided on the paper discharge tray 400. FIG. 13A illustrates a state where the alignment guides 401A and 401B are relatively open, and FIG. 13B illustrates a state where the alignment guides 401A and 401B are relatively closed. In the paper discharge tray 400, it is necessary to stack the recording media P discharged one after another from the main body of the ink jet recording apparatus 1 on the paper discharge tray 400 while aligning the recording media P. In addition, since the paper discharge tray 400 projects toward a front side from the main body of the ink jet recording apparatus 1 when in use, it is necessary to fold and store the paper discharge tray 400 when not in use. In the following description, the same reference numerals as those used in the first embodiment indicate the same members as those used in the first embodiment, and duplicate description thereof will be omitted.

The recording medium P recorded by the ink jet recording apparatus 1 is sent to the paper discharge tray 400. The paper discharge tray 400 is attached to the main body of the ink jet recording apparatus 1 so as to be rotatable around a rotation axis 440 illustrated by the line X2-X2 illustrated in FIG. 12A. The paper discharge tray 400 is provided with a pair of alignment guides 401A and 401B corresponding to both sides in order to align both sides of the discharged recording medium P and the alignment guides 401A and 401B constitute a paper alignment mechanism. The alignment guides 401A and 401B are driven in the directions E and F illustrated in the drawing in FIGS. 12A and 12B by a configuration having the rack members 408A and 408B and the pinion gear 409 similar to the configuration for driving the side guides 305A and 305B in the directions C and D in the first embodiment. The paper discharge tray 400 is provided with a paper discharge shift member (not illustrated) similar to the shift member 307 in the first embodiment, and an alignment guide 401A is attached to the paper discharge shift member via a friction member (not illustrated). By providing the friction member, it is possible to regulate an interval between the alignment guides 401A and 401B according to the width of the recording medium P similar to the first embodiment. In addition, also in the present embodiment, a fixing unit for fixing the angle of the paper discharge tray 400 with respect to the main body of the ink jet recording apparatus 1 at a predetermined angle may be provided.

The configuration for driving the alignment guides 401A and 401B will be briefly described. A cam follower 416 rotates about a shaft Z3 by being driven by a drive source (not illustrated) such as a motor provided in the ink jet recording apparatus 1. The shaft Z3 is orthogonal to the rotation axis 440 of the paper discharge tray 400, that is, the axis X2-X2. The operation arm 416A at the other end of the cam follower 416 pushes an operation lever 417 on the rotation axis 440 in the direction of the rotation axis 440. As a result, the operation lever 417 rotates about a rotation shaft Z4, and the paper discharge shift member is driven in the direction E illustrated in the drawing by pushing an abutting portion 407A of the paper discharge shift member. The alignment guide 401A and the rack member 408A, which are fixed to the paper discharge shift member via the friction member, are also driven together in the same direction as that of the paper discharge shift member, that is, in the direction E illustrated in the drawing. Since the pinion gear 409 is provided between the rack member 408A and the rack member 408B, the rack member 408B and the alignment guide 401B are driven in the direction F illustrated in the drawing. The two alignment guides 401A and 401B move in the direction of the recording medium P by this operation to narrow an interval between the alignment guides 401A and 401B, so that the edge portions on both sides of the recording medium P stacked on the paper discharge tray 400 are aligned.

Also in the present embodiment, it is possible to drive the alignment guides 401A and 401B in the same manner, regardless of the angle of the paper discharge tray 400 with respect to the main body of the ink jet recording apparatus 1 around the axis represented by the line X2-X2. Depending on the installation location of the ink jet recording apparatus 1, there may be one of a wall and other object in front of the ink jet recording apparatus 1, and the paper discharge tray 400 may not be sufficiently expanded. According to the present embodiment, even in a case where the paper discharge tray 400 cannot be sufficiently expanded, it is possible to align the paper with respect to the recording medium P after recording stacked on the paper discharge tray 400, and it is possible to provide a highly convenient ink jet recording apparatus 1.

According to each of the above-described embodiments, the operation of the handling mechanism (for example, drive timing and drive amount) provided on these trays can be the same for each of the paper feed tray 303 and the paper discharge tray 400, regardless of the angle with respect to the main body of the ink jet recording apparatus 1. As a result, stable operation of the handling mechanism can be obtained. Furthermore, it is possible to obtain a drive transmission mechanism of a feeding device having a high degree of configuration freedom, which does not cause an issue when the handling mechanism is stored.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-024188, filed Feb. 17, 2020, which is hereby incorporated by reference herein in its entirety.

What is claimed is:

1. A feeding device transport a recording medium, the feeding device comprising:

a main body having a drive source;

a tray that is attached to the main body and on which the recording medium is to be loaded;

a side guide unit provided on the tray and configured to move in a width direction of the recording medium to align positions of edge portions of the recording medium loaded on the tray;

an operation arm portion attached to the main body and configured to move in the width direction by rotational movement from a cam follower configured to receive a driving force from the drive source; and an operation lever configured to rotate around a rotation shaft and move the side guide unit in case the driving force is transmitted, wherein the operation arm portion transmits the driving force to the operation lever in case that the operation arm portion abuts on the operation lever, and wherein the tray is configured to rotate around a tray rotation axis of the tray, and the operation arm portion and the operation lever abut on each other at a position of the tray rotation axis.

2. The feeding device according to claim 1, wherein the tray is a paper feed tray on which the recording medium to be supplied to the main body is to be loaded.

3. The feeding device according to claim 2, further comprising side guides provided on the tray without extending onto a base of the main body and configured to be driven so as to be separated from the edge portions of the recording medium when the driving force is transmitted from the drive source.

4. The feeding device according to claim 3, wherein the side guides are part of the side guide unit and are provided corresponding to a pair of sides of the recording medium.

5. The feeding device according to claim 4, further comprising a friction member capable of regulating an interval between the side guides according to a width of the recording medium.

6. The feeding device according to claim 1, wherein the tray is a paper discharge tray on which the recording medium discharged from the main body is to be stacked.

7. The feeding device according to claim 6, further comprising side guides provided on the tray without extending onto a base of the main body and configured to be driven toward the edge portions when the driving force is transmitted from the drive source.

8. The feeding device according to claim 7, wherein each of a plurality of alignment guides is provided corresponding to a pair of sides of the recording medium.

9. The feeding device according to claim 8, further comprising a friction member capable of regulating an interval between the plurality of alignment guides according to a width of the recording medium.

10. The feeding device according to claim 1, further comprising a fixing unit configured to fix an angle of the tray with respect to the main body around the tray rotation axis at a predetermined angle.

11. The feeding device according to claim 10, wherein the fixing unit is configured to fix the angle of the tray at any of a plurality of angles.

12. The feeding device according to claim 11, wherein one of the plurality of angles of the tray is an angle for transporting the recording medium in a horizontal direction.

13. The feeding device according to claim 1, wherein the operation arm portion is configured to abut on the operation lever even as the operation lever rotates due to a change in an opening angle of the tray with respect to the main body.

14. The feeding device according claim 1, wherein the operation arm portion and the operation lever abut on each other at a location adjacent to a tray rotation axis of tray but not on the tray rotation axis.

15. The feeding device according claim 1, further comprising side guides provided on the tray without extending onto a base of the main body, wherein the feeding device is one of an ink jet recording apparatus, a copier, and a facsimile, and the side guides are separated from the recording medium during a recording operation such that a back tension applied to a transported recording medium is reduced and recording medium transport accuracy is increased.

16. The feeding device according claim 1, wherein the tray is configured to rotate relative to the main body around a tray rotation axis of the tray between a position where the tray can be stored in the main body when not in use and positions at predetermined angles where the tray is configured to feed recording media to a recording region, and wherein the operation arm portion and the operation lever abut on each other, even when the operation arm portion and the operation lever rotate relative to each other around the tray rotation axis such that the operation arm portion transmits the driving force to the operation lever regardless of an angle of the tray.

17. The feeding device according to claim 1, further comprising:

a first paper feed roller configured to feed a first recording medium loaded on a first paper feed unit to a recording head; and a second paper feed roller configured to feed a second recording medium loaded on a second paper feed unit to the recording head, wherein (i) a base of the main body is provided with the second paper feed roller, (ii) the second paper feed roller, the base, and the tray are part of the second paper feed unit, and (iii) a thickness of the second recording medium relative to a thickness of the first recording medium is such that the first paper feed unit is configured to feed the first recording medium and is configured not to feed the second recording medium.

18. A feeding device to transport a recording medium, the feeding device comprising:

a main body having a drive source;

a tray that is attached to the main body and on which the recording medium is to be loaded;

a side guide unit provided on the tray and configured to move in a width direction of the recording medium to align positions of edge portions of the recording medium loaded on the tray;

an operation arm portion attached to the main body and configured to move in the width direction by rotational movement from a cam follower configured to receive a driving force from the drive source; and an operation lever configured to rotate around a rotation shaft and move the side guide unit in case the driving force is transmitted, wherein the operation arm portion transmits the driving force to the operation lever in case that the operation arm portion abuts on the operation lever, and wherein the operation arm portion is formed at one end of the cam follower that is rotatable around an axis orthogonal to the width direction and the other end of the cam follower is configured to abut on a cam driven by the drive source.

19. The feeding device according to claim 18, wherein the cam is configured to be driven by the drive source and rotate around an axis parallel to the width direction.

20. A printing apparatus comprising:

a printing unit configured to perform printing on a recording medium;

a main body having the printing unit, a base, and a drive source;

a tray that is rotatably attached to the base and on which the recording medium is to be loaded;

a side guide unit having side guides provided on the tray without extending onto the base and configured to move relative to each other in a width direction of the recording medium to align positions of edge portions of the recording medium loaded on the tray;

an operation arm portion attached to the main body and configured to move in the width direction by rotational movement from a cam follower configured to receive a driving force from the drive source; and an operation lever configured to rotate around a rotation shaft and move the side guides in case the driving force is transmitted, wherein the operation arm portion transmits the driving force to the operation lever in case that the operation arm portion abuts on the operation lever, and wherein the tray is configured to rotate around a tray rotation axis of the tray, and the operation arm portion and the operation lever abut on each other at a position of the tray rotation axis.

21. The printing apparatus according to claim 20, wherein the operation arm portion is formed at one end of the cam follower that is rotatable around an axis orthogonal to the width direction and the other end of the cam follower is configured to abut on a cam driven by the drive source.

22. The printing apparatus according to claim 21, wherein the cam is configured to be driven by the drive source and rotate around an axis parallel to the width direction.

23. The printing apparatus according to claim 20, wherein the tray is a paper feed tray on which the recording medium to be supplied to the main body is to be loaded.

24. The printing apparatus according to claim 23, wherein the side guide unit is configured to be driven so that the side guides are separated from the edge portions of the recording medium when the driving force is transmitted from the drive source.

25. The printing apparatus according to claim 24, wherein the side guides are provided corresponding to a pair of sides of the recording medium.

26. The printing apparatus according to claim 25, further comprising a friction member capable of regulating an interval between the side guides according to a width of the recording medium.

* * * * *